United States Patent [19]

Payne

[11] Patent Number: 4,915,251

[45] Date of Patent: Apr. 10, 1990

[54] SNAPLOCK THERMOFORMED CONTAINER

[75] Inventor: Joe R. Payne, La Habra, Calif.

[73] Assignee: Dolco Packaging Corporation, Sherman Oaks, Calif.

[21] Appl. No.: 267,700

[22] Filed: Nov. 4, 1988

Related U.S. Application Data

[63] Continuation of Ser. No. 75,797, Jul. 20, 1987, abandoned.

[51] Int. Cl.[4] ..... B65D 41/16

[52] U.S. Cl. ..... 220/306; 229/2.5 R

[58] Field of Search ..... 220/4 B, 4 E, 306, 307; 229/2.5 R, 2.5 EC

[56] References Cited

U.S. PATENT DOCUMENTS

| | | | |
|---|---|---|---|
| 3,935,962 | 2/1976 | Schubert et al. | 220/306 |
| 4,057,169 | 11/1977 | Payne | 220/306 |
| 4,079,880 | 3/1978 | Edwards | 220/306 X |
| 4,132,344 | 1/1979 | Jewell | 229/2.5 R |
| 4,150,777 | 4/1979 | Cyr et al. | 229/2.5 R |
| 4,183,446 | 1/1980 | Davis | 220/306 |
| 4,298,133 | 11/1981 | Davis | 220/306 |
| 4,582,248 | 4/1986 | Bixler et al. | 229/2.5 R X |
| 4,653,685 | 3/1987 | Leary et al. | 229/2.5 R |

*Primary Examiner*—Stephen Marcus
*Assistant Examiner*—Nova Stucker
*Attorney, Agent, or Firm*—Nilsson, Robbins, Dalgarn, Berliner, Carson & Wurst

[57] ABSTRACT

A thermoformed plastic carton constructed from two half sections which are integrally connected along one side by a hingable joint to allow the half sections to be folded upon each other. The carton further includes resiliently deflectable latches extending up from an edge of one carton half which mate with and become lodged in a receptacle formed in the other carton half section when the carton half sections are folded one upon another.

20 Claims, 3 Drawing Sheets

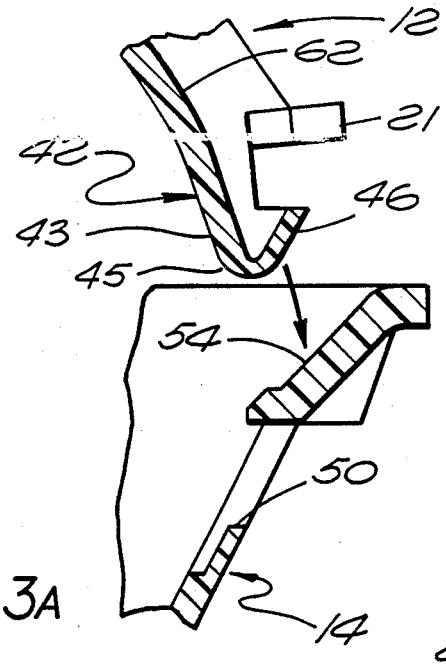
FIG. 3A
FIG. 3B
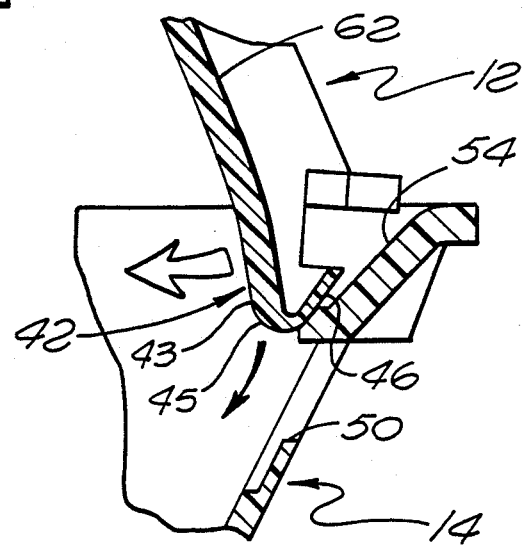
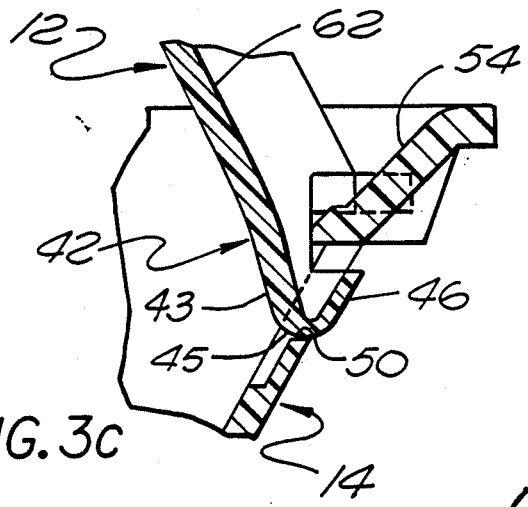
FIG. 3C
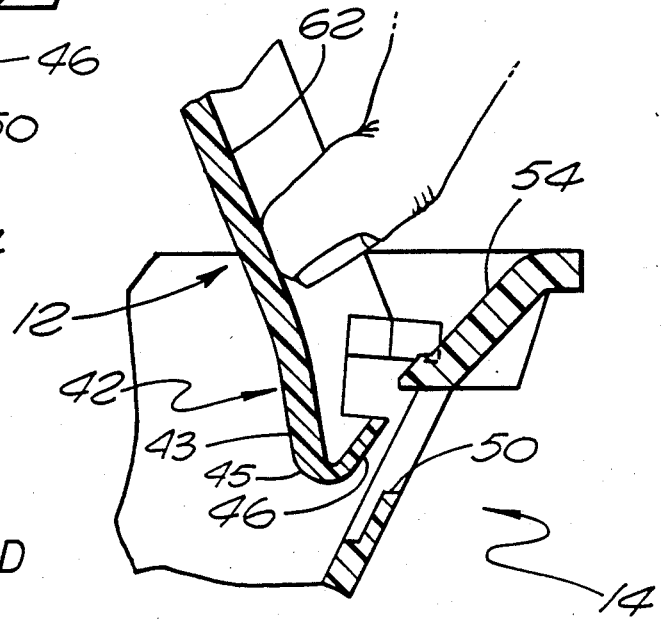
FIG. 3D

SNAPLOCK THERMOFORMED CONTAINER

This is a continuation of co-pending application Ser. No. 07/075,797 filed on July 20, 1987, now abandoned.

BACKGROUND OF THE INVENTION

The invention is directed to lockable cartons, more specifically to lockable cartons formed from two half sections which are foldable onto one another, and which can be releasably locked together. One of the carton sections is formed with one or more compartments, with the second section forming the carton cover.

There are many types of lockable cartons which have been designed and used for storing many types of products, e.g., perishable food cartons. Depending upon the type of food the carton is designed to hold the base is formed with one or more compartments. Egg cartons are designed with the base formed with rows of multiple egg compartments, while those designed for hamburgers or sandwiches include a base having one or more compartments for receiving the sandwich and accompanying salads.

The carton cover may either be separate or integrally connected along one side to the base portion. The latter type of covers are designed to be folded over and temporarily locked to the base portion. Typically, either the cover or base is formed with a latch which can clasp a portion of the other carton section. This latch is designed to allow the two sections to be releasably held together.

Generally, food cartons are manufactured from either wood pulp or a thermoformed plastic. Wood pulp cartons are generally more rigid, while thermoformed plastic cartons provide a degree of thermal insulation and are particularly useful for hot and cold foods. However, one particular disadvantage with thermoformed plastic cartons results from the method of manufacturing the carton. If during the forming process the plastic is stretched it may become weakened at the stretched portion. Since thermoformed cartons are typically formed by pressing a plastic sheet between two heated mold platens the possibility of stretching the plastic sheet is dependent upon the design of the carton.

This potential weakening of a stretched portion of the plastic is particularly critical if the stretching occurs in the locking latches. The integrity of the locking latches is critical in order to provide a reliable clasping of the carton sections together. For certain applications it is desirable to extend the locking latches upwards from the carton half. This better positions the locking latch to clasp onto the oppposing carton half. However, in order to avoid the problems associated with stretching the plastic during the thermoforming process, the carton latches are typically not formed as independent structures, but are formed as part of a flap which extends out along the length of the carton side.

Examples of cartons which are designed to avoid stretching the plastic by forming one or more latches as a flap are disclosed in U.S. Pat. Nos. 4,612,153; 4,625,905; 4,625,906; and 4,625,907, all of which were issued to Raj K. Mangla and assigned to Mobile Oil Corporation. These patents also discuss the disadvantages associated with stretching the plastic, and primarily in forming the locking latches.

SUMMARY OF THE DISCLOSURE

The invention is directed to thermoformed plastic cartons. The cartons are constructed from two half sections which are integrally connected along one side. These half sections are also formed to be foldable upon each other and releasably locked together. At least one of the carton half sections is formed with one or more compartments. Furthermore, at least one of the half sections is formed with a mechanism for releasably locking the half sections along one side.

Specifically, at least one of the carton half sections is formed with one or more upwardly extending, resiliently deflectable latches. The carton half sections are releasable secured together by positioning the locking latch to clasp a respectively formed portion of the other carton half section. Typically, this formed portion is a receptacle, e.g. a cut-out which receives at least part of the latch. The resiliency and deflectability of the latch allows the same to be moved into alignment with the receptacle. In this regard the latches will typically engage a portion of the other carton half when being moved into position to engage the receptacle. This portion deflects the latch generally inward, that is away from the other carton half section. The latch will remain deflected until reaching the receptacle, upon which the latch snaps back in the opposite direction and enters the receptacle. The carton half section including the latches is further formed with a mechanism which is operable for urging the latches out of the receptacle.

BRIEF DESCRIPTION OF THE DRAWINGS

The present invention may be better understood and its advantages will be apparent to those skilled in the art by reference to the accompanying drawings, wherein like reference numerals refer to like elements in the several Figures, and wherein:

FIGS. 3A–D are cross-sectional views of a locking latch formed in one carton half shown being moved into engagement with a cut out formed in the other carton half in a step by step approach.

DESCRIPTION OF THE INVENTION

The invention is directed to thermoformed plastic cartons having two integrally connected half sections. These half sections are integrally connected along one side and can be folded onto each other. Furthermore, the carton includes a mechanism for releasable securing one half section to the other. At least one half is formed with one or more compartments.

More specifically, the carton includes a base and cover section which are integrally connected along one side by a hingable joint. The base is formed with one or more compartments for receiving articles, e.g. food. The side of either the base or cover positioned opposite the hingable joint includes at least one resiliently deflectable latch. This latch is formed to releasably clasp onto an appropriately formed portion of the other carton half section. Typically, this portion is a receptacle which will receive part of the latch.

Figure 1:
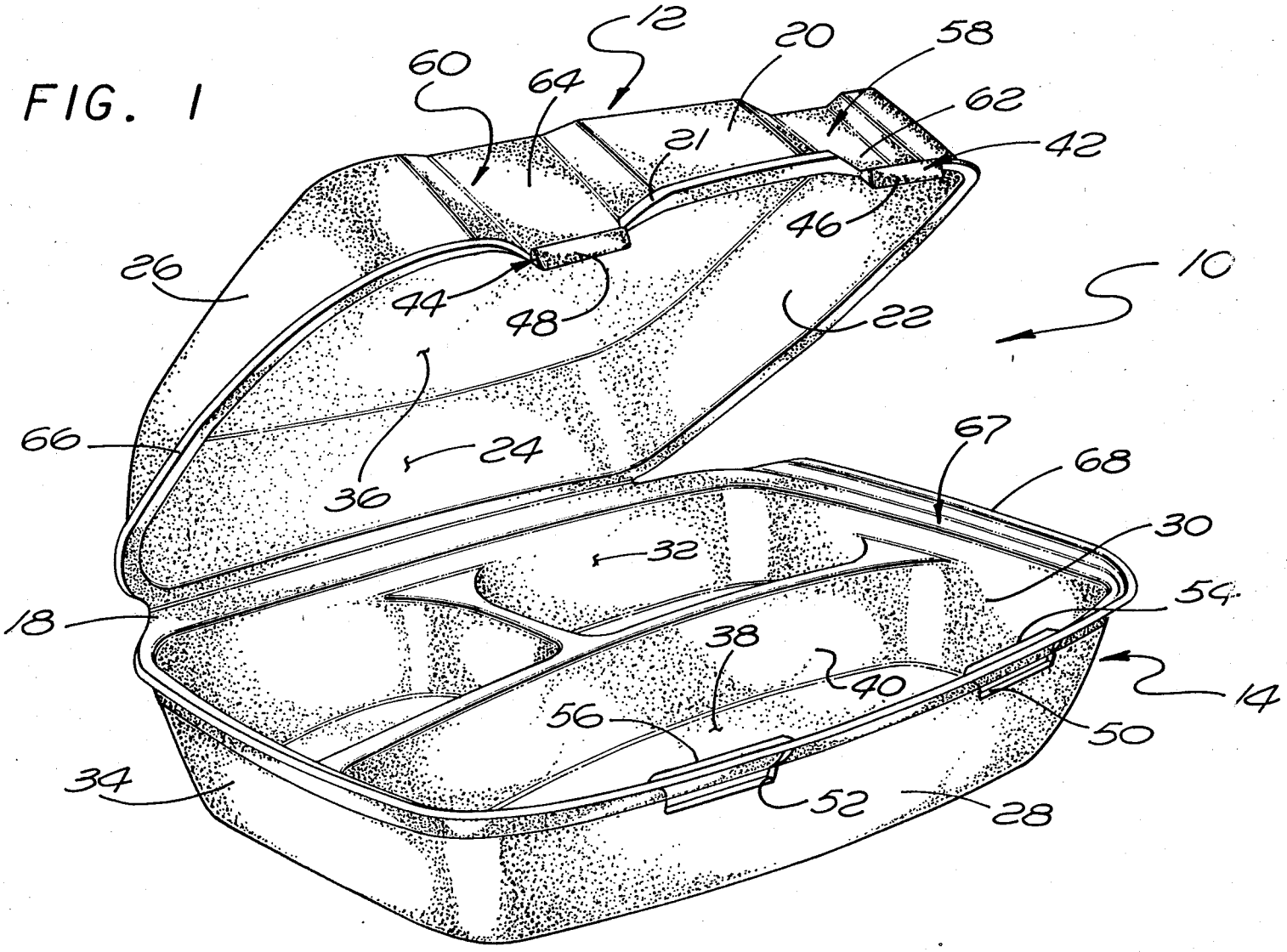
FIG. 1 is a side perspective view of a carton in accordance with an embodiment of the invention.
Figure 2:
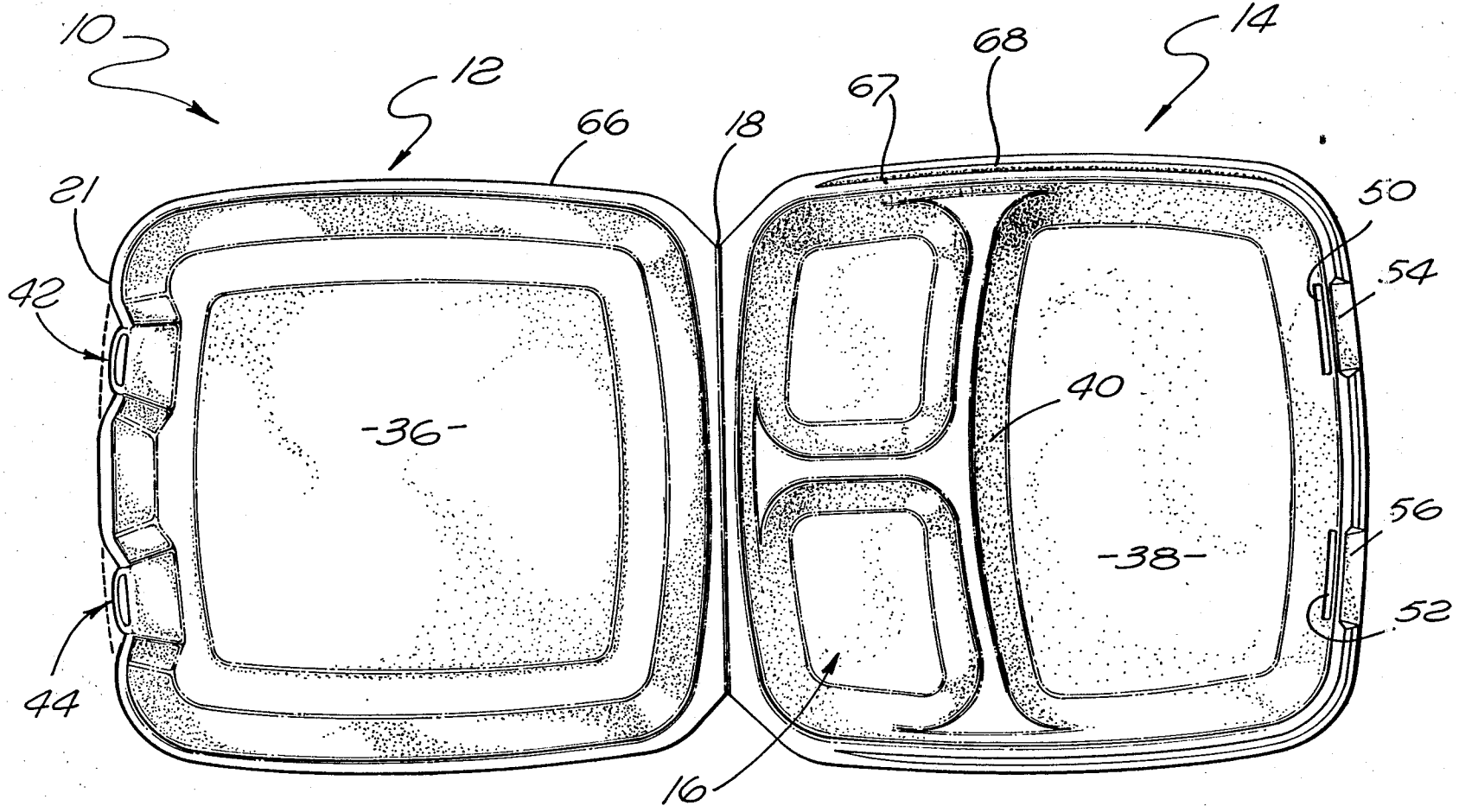
FIG. 2 is a planar view of the carton of FIG. 1 displaying the interior defining portion of each carton half.

Referring now to FIGS. 1 and 2 simultaneously, the carton is seen generally at 10. Carton 10 includes a cover 12 and a base 14. Both the base 14 and cover 12 are generally box-like structures. That is, both the cover 12 and base 14 are formed by four interconnected peripheral side walls, those being walls 20, 22, 24 and 26 for cover 12, and walls 28, 30, 32, and 34 for base 14, which are commonly connected to a top or floor wall 36 or 38, respectively.

The base 14 includes three compartments, one of which is seen generally at 16. These compartments 16 are defined by a divider wall 40 which extends up from the floor wall 38 and is secured between the four side walls 28, 30, 32, and 34.

The cover 12 and base 14 are integrally joined along one side by a hingable joint 18. As illustrated this joint 18 lies between side walls 24 and 32, respectively. This hingable joint 18 allows the cover 12 and base 14 to be folded upon one another, and thus enclose an article inside the carton 10.

The precise configuration of the cover 12 and base 14 is not critical to the invention, for that matter the construction of the divider wall 40, or even the existence of this wall 40 is also not critical to the invention. Thus, the carton half sections 12 and 14 may have a rectangular, oval or other desired shape. The divider wall 40 may be formed to subdivide the base 14 into two or more compartments 16.

As stated, the carton 10 includes one or more latches, two of which are generally seen at 42 and 44. These latches 42 and 44 extend up from a side edge of one of cover 12 or base 14. As illustrated the latches 42 and 44 extend up from the side wall edge 21 of the cover 12 side 20. These latches 42 and 44 are constructed to clasp onto the a portion of the base 14 when brought into engagement therewith. In this manner, the cover 12 and base 14 can be folded onto one another and secured together using the latches.

The latches 42 and 44 are generally hook-shaped, and are each formed with an extending portion 43 (see FIGS. 3A–3D), a curved portion 45, and an outwardly jutting head, 46 and 48, respectively. The outwardly jutting heads 46 or 48 are dimensioned to fit into a respective cut-out 50 or 52 formed in the side wall 26 of the base 14. The latches 42 and 44 are formed to inhibit the withdrawal of the head 46 or 48 from the respective cut-out 50 or 52 under normal use of the carton 10. This provides a mechanism for securely closing the carton 10.

Since the latches 42 and 44 are constructed from a thermoformed plastic they are resiliently deflectable to allow the latches 42 and 44 to be independently moved in opposing directions. Generally the latches can be moved either away from or towards the base 14 when the cover 12 is folded thereon. As will be discussed more fully this resiliency allows the latch head 46 or 48 to be independently dislodged from the respective cut-out 50 or 52 by moving the latches 42 or 44 away from the base 14. Thus the carton 10 is easily closed and opened using the latches 42 and 44 in combination with the cut-outs 50 and 52.

Furthermore, when the cover 12 is being folded onto the base 14 the heads 46 and 48 are formed to cam against and along a bearing surface formed contiguous to each of the cut-outs 50 and 52. Two of such surfaces are indicated generally at 54 and 56, respectively. As the heads 46 and 48 engage the cam along these surfaces 54 and 56 the respective latches 42 and 44 are deflected away from the sidewall 28 of base 14. The latches 42 and 44 remain deflected until the heads 46 and 48 reach the respective cut-out 50 and 52. At this point the latches 42 and 44 will move quickly generally towards the sidewall 28 of base 14. This movement of the latches 42 and 44 causes the heads 46 and 48 to become firmly lodged in the respective cut-out 50 and 52.

Referring to FIGS. 3A–3D, the operation of the latches 42 and 44 will be described in greater detail. As seen in FIG. 3A, the cover 12 is being folded over upon the base 14. This brings the latches, here only latch 42 is shown, towards the bearing surface 54 adjacent the cut-out 50. As the cover 12 is moved further the latch head 46 engages this surface 54 which causes the deflection of the latch 42 away from the base 14 as seen in FIG. 3B. This deflection of the latch 42 continues until the head 46 reaches the cut-out 50. The latch 42 will then travel or snap in an opposite direction to lodge the head 46 in the cut-out 50, as seen in FIG. 3C. This secures the cover 12 and base 14 together.

As stated, when it is desired to release the cover 12 from the base 14 the latches 42 and 44 are independently moved to dislodge the heads 46 and 48 from the respective one of the cut-outs 50 and 52. This dislodging of the heads 46 and 48 may be performed by merely pressing upon the wall 20 at a location contiguous to the respective latch 42 or 44.

Referring to FIGS. 1 and 2, a more preferred embodiment which includes a mechanism to facilitate the dislodging of the heads 46 and 48 is seen. The cover is formed with two depressions 58 and 60 in the side wall 20 located contiguous the latches 42 and 44. More specifically each depression 58 and 60 is a trough shaped depression having a base surface, seen at 62 and 64, which also forms a surface of the contiguous latch 42 or 44. By applying pressure to the cover 12 in either one of the depressions 58 or 60, more particularly by pressing against the surfaces 62 or 64, the associated latch 42 or 44 is moved away from the base 14. This dislodges the head 46 or 48 from out of the respective cut-out 50 or 52. This operation of dislodging the head 46 from out of the cut-out 50 is better seen in FIG. 3D.

In accordance with a still further preferred embodiment, the cover 12 is formed with a peripherally extending rim 66. This rim 66 is formed to rest in a trough 67 formed about the periphery of the base 14 by an upwardly extend peripheral shirt 68. Both the rim 66 and skirt 68 are formed along those three side walls of the cover 12 and base 14 respectively which do not form a portion of the hinged joint 18. When the cover 12 and base 14 are folded upon one another the rim 66 becomes lodged in the trough 67 formed by the skirt 68.

The combination of the rim 66 and skirt 68 functions to align the latch heads 46 and 48 up with the cut-outs 50 and 52, respectively, as the cover 12 is being folded upon the base 14. That is, when the cover 12 is being folded onto the base 14 the rim 66 and skirt 68 act against each other to cause the cover 12 and base 14 to move with respect to each other. This positioning of the cover 12 and base 14 forces the latches 42 and 44 towards the respective cut-outs 50 and 52. The rim 66 and skirt 68 also limit lateral movement of the cover 12 and base 14 when the two have been positioned together. The limiting of the lateral movement further limits the potential of the latch heads 46 and 48 becoming dislodged from the respective cut-outs 50 and 52. Thus the lodging of the latch heads 46 and 48 in the respective cut-outs 50 and 52, in combination with the interaction of the rim 66 and skirt 68 retains the cover 12 closed upon the base 14, until the latch heads 46 or 48 are purposely dislodged by pressing in on the associated depression surfaces 62 or 64.

The method of forming the latches 42 and 44 minimizes the potential of stretching the plastic and thus weakening the latches during the thermoforming process. This ensures that the latches will be formed rigid. This allows each of the latches 42 and 44 to be formed independently from the other, and not as a flap as is required with some presently available cartons.

Specifically, the carton latches 42 and 44 are formed not by stretching the plastic, but by cutting, or severing in any manner, a portion of the plastic which would have formed part of the rim 66. This cut portion of the plastic is molded to form the latch and latch head. This method of forming the latches 42 and 44 limits any stretching of the plastic during the thermoforming process. Thus the latches formed in this manner are rigid, and can be formed to extend out sufficiently enough to position the latch heads for lodging into a respective cut-out.

While the preferred embodiment has been described and illustrated, various substitutions and modifications may be made thereto without departing from the scope of the invention. Accordingly, it is to be understood that the present invention has been described by way of illustration and not limitation.

What is claimed is:

1. A thermoplastic carton comprising:

a cover section and a base section which are integrally connected by a hingable joint along a common side, said cover section and base section having a top wall and floor wall, respectively, each of said walls facing upward when said sections are in a fully open, side-by-side position, one of said sections being formed with at least one hook-shaped latch means which is resiliently movable in two opposing directions, said latch means having an extending portion which extends up from and is integral with a side edge of said section when said carton is in the fully open position, a jutting head which extends downward in the fully open position and a curved portion integrally connecting said extending portion and said jutting head, said other of said sections including at least one receptacle formed to receive said jutting head of said latch means when said jutting head is brought into engagement therewith, said latch means being formed to cam against and along a camming surface of said other section as said sections are folded upon one another whereby said latch means is moved in a first opposing direction away from said other section, and wherein said latch means will move in a second opposite direction when said jutting head reaches said receptacle upon which said jutting head becomes lodged in said receptacle.

2. The carton of claim 1 wherein said camming surface is located adjacent to said receptacle and between said receptacle and an edge of said carton section, said camming surface being formed to purposely deflect said latch means away from said section when said jutting head engages said camming surface.

3. The carton of claim 1 wherein said carton section including said latch means is further formed at a location contiguous to and integrally with said latch means with a release means operable for moving said latch means in said first opposing direction to dislodge said jutting head from said receptacle.

4. The carton of claim 1 wherein said carton sections are further formed with an alignment means for aligning said latch means with said receptacle as said sections are being folded upon one another.

5. The carton of claim 1 wherein said camming surface is located adjacent to said receptacle upon which said latch means will bear as said sections are closed upon one another to urge said latch means in said first direction, said surface being located between said receptacle and an edge of said carton section.

6. A thermoformed thermoplastic carton comprising:

a cover and base section which are each a substantially box-like structure having one open side, said cover and base being integrally connected along a common side with a hingable joint to allow said sections to be folded upn one another;

at least two resiliently deflectable latches extending independently up from an edge of a side of said cover section positioned opposite said hingable joint, each of said latches having a jutting head positioned along said latch away from said edge of said side of said cover section;

at least two receptacles formed in a side of said base section opposite said hingable joint which are each dimensioned and positioned to receive a jutting head of a properly aligned one of said latch means when said sections are folded upon one another; and release means associated with each of said latch means which are independently operable to dislodge said jutting head from said receptacle.

7. The carton of claim 6 wherein said base section is further formed with at least two surfaces each located between an edge of said section side and a respective one of said receptacles upon which one of said latches will bear as said sections are closed upon one another to urge said latches in a first opposing direction away from said base section.

8. The carton of claim 7 wherein said receptacle is a cut-out formed in said base section side.

9. The carton of claim 8 wherein said release means is a depression formed in said cover section side at a location contiguous to said latch means, said depression is defined by a surface which is integral with said latch means, whereupon pressing said depression surface causes said jutting head to become dislodged from said receptacle.

10. The carton of claim 6 wherein said cover section is formed with an outwardly extending peripheral rim, and said base section is formed with an outwardly extending peripheral skirt for receiving said rim when said sections are folded one upon another, whereby said jutting heads become aligned with said receptacles as said sections are folded upon one another.

11. A thermoplastic carton comprising:

a cover section and a base section each having inside portions which face each other when said sections are in a fully closed position;

one of said sections being formed with at least one latch means which extends from said section in a first direction towards said other section when the sections are in the fully closed position;

each of said latch means having a jutting head protruding in a second direction lateral to said first direction and having a thickness measured along said first direction greater than the thickness of the thermoplastic carton; and said other of said sections including at least one receptacle formed to receive said respective jutting head of said latch means when said jutting head is brought into engagement therewith.

12. The carton of claim 11 wherein each of said latch means is resiliently movable in first and second opposing directions, with said first opposing direction being away from said other section when said sections are placed into engagement with each other.

13. The carton of claim 12 wherein each of said latch means will move in said second opposing direction when said jutting head reaches its respective receptacle.

14. The carton of claim 13 wherein said other section further includes at least one camming surface formed contiguous to said receptive receptacle upon which said respective jutting head bears to move said respective latch means in said first opposing direction when said sections are placed into engagement with each other.

15. The carton of claim 14 futher including an alignment means for aligning each of said latch means with each of said receptacles when said sections are placed in engagement with each other.

16. A thermoplastic carton comprising:

a cover section and a base section each having inside portions which face each other when said sections are in a fully closed position;

one of said sections being formed wiith an outwardly extending rim, a portion of said rim being partially severed and molded to form a latch means which extends from said section in a first direction towards said other section when the two sections are in the fully closed position;

each of said latch means having a jutting head protruding in a second direction lateral to said first direction and having a thickness measured along said first direction greater than the thickness of the thermoplastic carton; and said other of said sections having an outwardly extending peripheral shirt for receiving said rim when said sections are in the fully closed position and a receptacle formed to receive said jutting head of said latch means when said jutting head is brought into engagement therewith.

17. The carton of claim 16 wherein said cover and base sections are integrally connected along a common side with a hingable joint to allow said sections to be folded upon one another.

18. The carton of claim 17 wherein said latch means is resiliently moveable in two opposing directions and wherein said jutting head has an outer surface formed to cam against and along a camming surface of said outer sections as said sections are folded upon one another whereby said latch means is moved in a first opposing direction away from said other section, and wherein said latch means will move in a second opposite direction when said jutting head reaches said receptacle upon which said jutting head becomes lodged in said receptacle.

19. The carton of claim 18 wherein said rim and skirt are formed to align said latch means with said receptacle as said sections are folded upon one another.

20. The carton of claim 19, wherein said latch means is hook-shaped.

* * * * *